United States Patent [19]

Holbrook et al.

[11] Patent Number: 4,930,764

[45] Date of Patent: Jun. 5, 1990

[54] FRONT END FEEDER FOR MAIL HANDLING MACHINE

[75] Inventors: Russell W. Holbrook, Ridgefield; Walter J. Kulpa, Trumbull; James Morabito, Bethel, all of Conn.

[73] Assignee: Pitney Bowes Inc., Stamford, Conn.

[21] Appl. No.: 291,024

[22] Filed: Dec. 28, 1988

[51] Int. Cl.[5] ..... B65H 3/06; B65H 3/46

[52] U.S. Cl. ..... 271/119; 271/2; 271/166; 414/795.7; 414/797.7

[58] Field of Search ..... 271/2, 37, 119, 165, 271/166, 241, 253; 414/795.7, 796.1, 797.7, 797.6

[56] References Cited

U.S. PATENT DOCUMENTS

| | | | |
|---|---|---|---|
| 551,724 | 12/1895 | Dummer . | |
| 1,624,899 | 4/1927 | Northrop | 271/2 |
| 1,737,670 | 12/1929 | Ogden et al. | 271/2 |
| 2,390,573 | 12/1945 | Dohl et al. | 271/166 |
| 2,841,394 | 7/1958 | Stobb | 271/214 X |
| 3,506,258 | 4/1970 | Lindquist | 271/119 |
| 3,532,338 | 10/1970 | Brinson et al. | 271/233 |
| 3,877,531 | 4/1975 | Storace et al. | 177/1 |
| 4,081,181 | 3/1978 | Crowe et al. | 414/797.6 X |
| 4,232,860 | 11/1980 | Brown | 271/119 |
| 4,266,762 | 5/1981 | Kramer et al. | 271/225 |
| 4,318,540 | 3/1982 | Paananen et al. | 271/4 |
| 4,397,456 | 8/1983 | Eberle | 271/35 X |
| 4,428,573 | 1/1984 | Denison, III et al. | 271/305 |
| 4,653,742 | 3/1987 | Sasaki et al. | 271/114 |
| 4,715,593 | 12/1987 | Godlewski | 271/10 |
| 4,730,821 | 3/1988 | Flückiger | 270/58 |
| 4,753,432 | 6/1988 | Freeman | 271/35 |
| 4,817,368 | 4/1989 | DePasquale et al. | 271/119 X |

FOREIGN PATENT DOCUMENTS

| | | | |
|---|---|---|---|
| WO88/02734 | 4/1988 | World Int. Prop. O. | 271/119 |

*Primary Examiner*—Robert J. Spar
*Assistant Examiner*—Janice Krizek
*Attorney, Agent, or Firm*—Charles G. Parks, Jr.; David E. Pitchenik; Melvin J. Scolnick

[57] ABSTRACT

The front feeder for a high speed machine for handling mixed mail, including a nudger drive assembly for advancing the mail pieces while maintaining registration, and for fluffing a stack of mail contributing to preshingling of the mail as it is advanced downstream, angled decks and a back prop for a guideless hopper region, a tamper subsystem for maintaining registration of flapped envelopes, and structure configured to guide open envelope flaps along a slot for downstream sealing purposes.

22 Claims, 12 Drawing Sheets

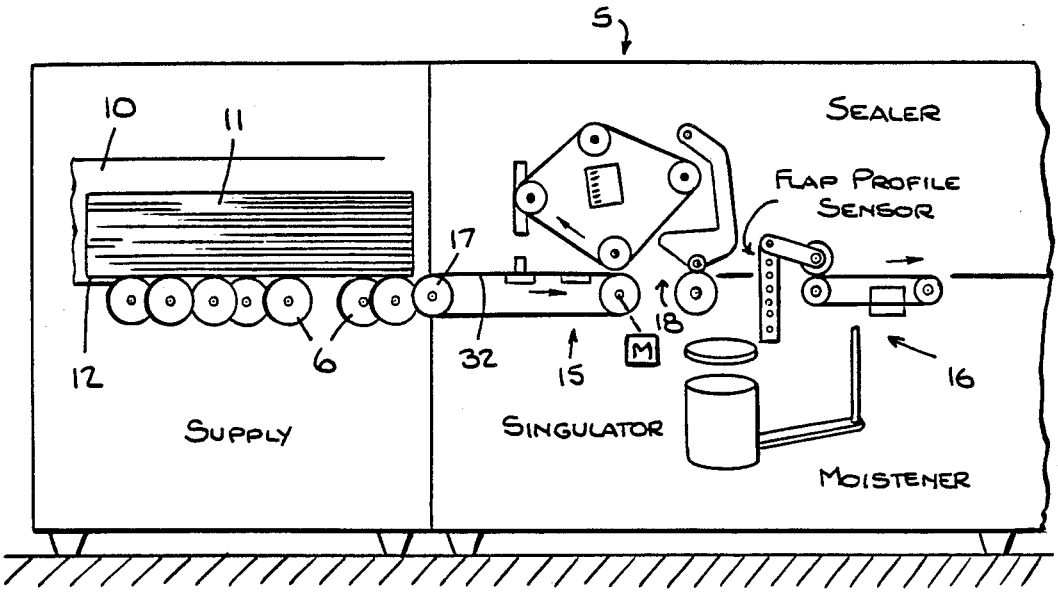
Fig. 1.
Fig. 2.
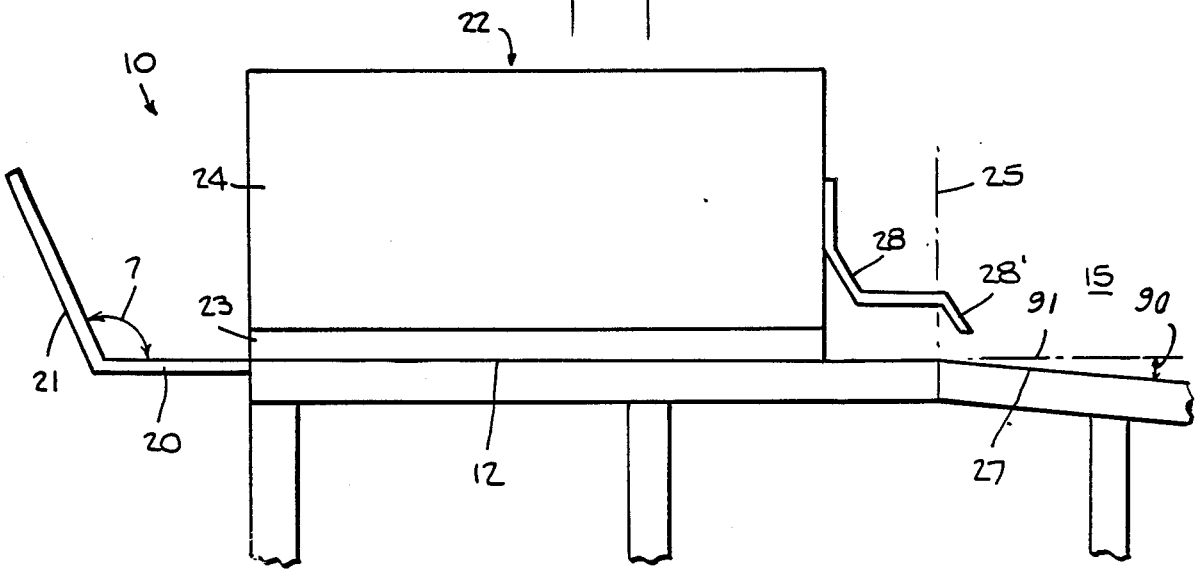

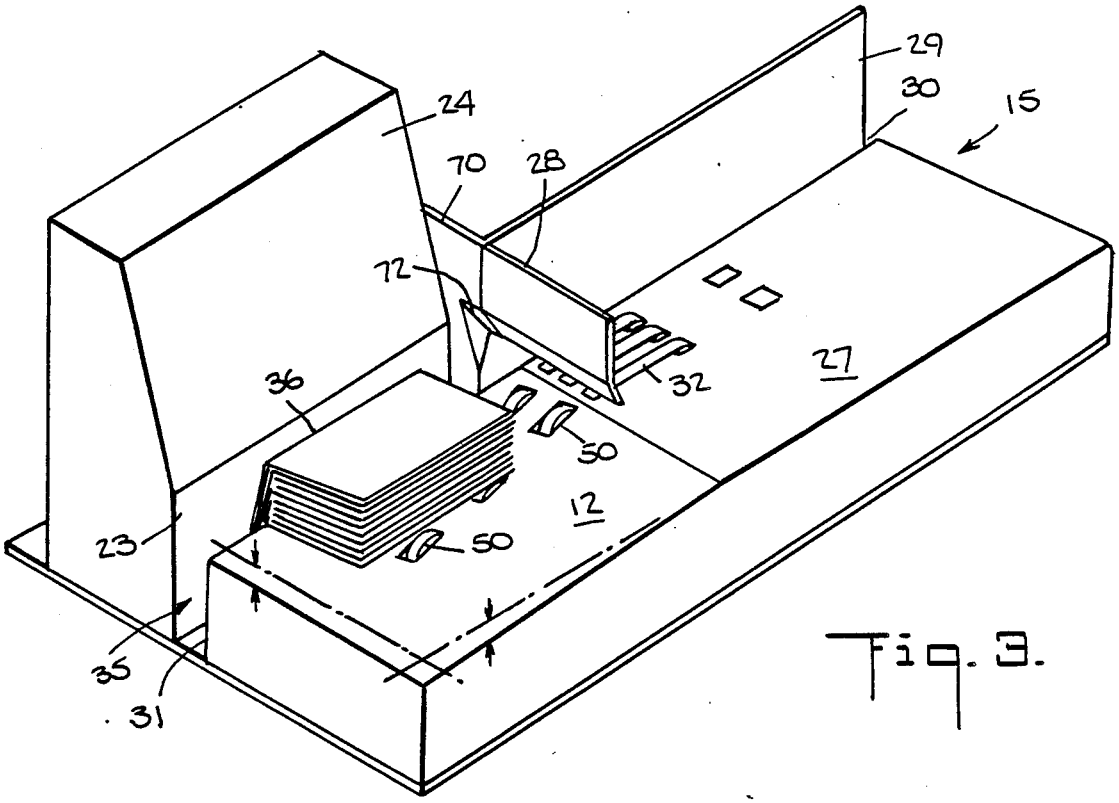
Fig. 3.
Fig. 4.
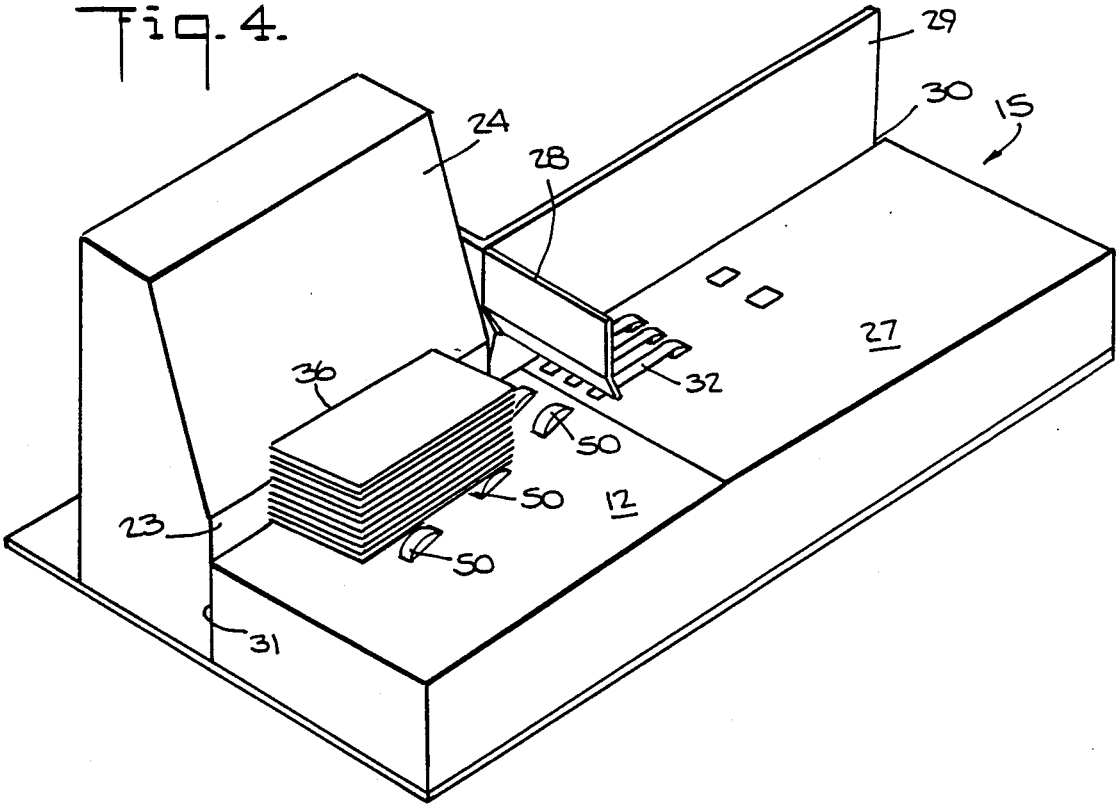

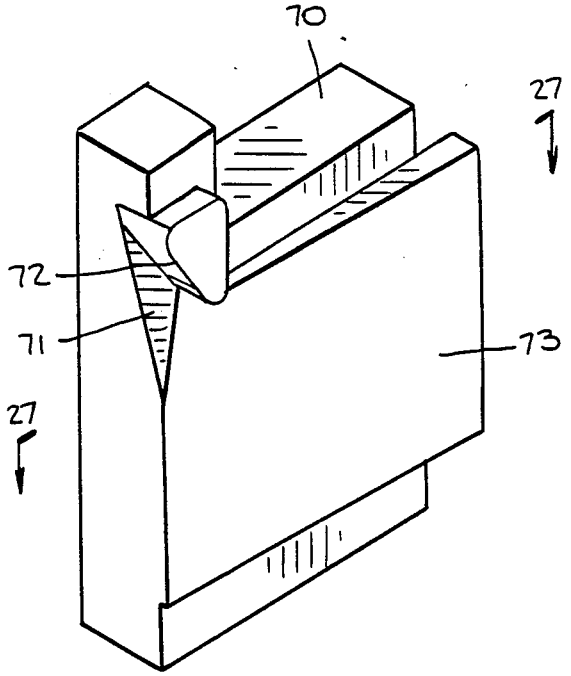
Fig. 26.
Fig. 27.
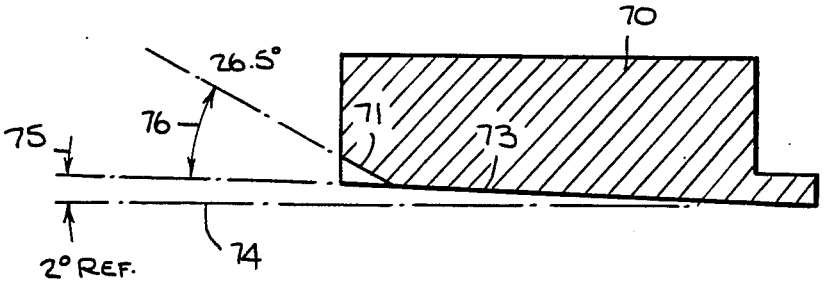

FRONT END FEEDER FOR MAIL HANDLING MACHINE

FIELD OF THE INVENTION

This invention relates to a front end feeder for a mail handling machine, and in particular for a machine for high speed processing of mixed mail.

BACKGROUND OF THE INVENTION

State of the art mailing machines can perform such automatic functions as handling mail of different sizes and thicknesses, envelope sealing, mail weighing, mail stamping, and mail sorting. The typical processing sequence starts at the front end of the machine where the mail is stacked. The stacked mail is then registered against a reference wall of the machine and the next step in the process is to feed the mail to a singulator to remove individual mail pieces from the bottom of the stack and thereafter process those individual mail pieces in serial fashion through the various modules of the machine.

Special problems arise when the mail to be handled is mixed mail, meaning envelopes containing inserts that have their flaps sealed, or closed but unsealed, or open. The problems intensify when an added requirement is the ability to process envelopes of varying sizes, for example from No. 6 to No. 15, and of varying thickness, say from thin air mail with a single insert up to three-quarters of an inch. Further problems arise when an additional added requirement is high-speed processing, up to four per second. To our knowledge, there exists no mail handling machine capable of high speed processing of mixed mail of varying size and thickness.

BRIEF DESCRIPTION OF THE INVENTION

An object of the invention is a front end feeder for high-speed processing of mixed mail.

Another object of the invention is a front end feeder capable of delivering mail pieces to a singulator at the rate of up to four per second.

Still another object of the invention is a front end feeder capable of properly feeding mixed mail to a downstream singulator.

A further object of the invention is a front end feeder capable of properly feeding envelopes having a wide range of sizes and thicknesses to downstream modules for further processing.

These and other objects and advantages as will be apparent hereinafter are achieved with a front end feeder comprising a hopper region for receiving a stack of horizontally oriented mail and including a bottom or deck surface and an upstanding wall serving as a registration surface against which the flap edge of the envelopes is to be made to bear.

In accordance with one broad aspect of the invention, the hopper region is provided with means to deliver the mail pieces pre-shingled to the downstream module. A feature of this aspect of the invention is the provision of means for fluffing the mail to enable the mail to slide more easily over one another.

In accordance with another broad aspect of the invention, means are provided for continually urging the mail pieces while in the hopper region downstream as well as toward the registration wall. A feature of this aspect of the invention is compound slanting of the mail deck in the hopper region.

In accordance with a further broad aspect of the invention, the registration wall is movable, and means are provided for the registration wall to tamp with varying force the adjacent edges of flapped mail pieces.

SUMMARY OF DRAWINGS

These and other features and advantages will become clearer from the detailed description given below of one embodiment of a front end feeder of the invention, taken in conjunction with the accompanying drawings wherein:

FIG. 1 is a schematic side view of part of a mail handling machine employing one form of front end feeder in accordance with the invention;

FIG. 2 is a more detailed side view of the front end feeder illustrated in FIG. 1;

FIGS. 3 and 4 ar perspective views of part of the feeder of FIG. 1 illustrating action of the tamper subsystem;

FIG. 13 is a rear perspective view of the tamper subassembly used in the feeder of FIG. 1;

FIGS. 26 and 27 are perspective and top views, respectively, of the guiding structure for the envelope flaps just downstream of the tamper subsystem.

DETAILED DESCRIPTION OF PREFERRED EMBODIMENTS

Figure 5:
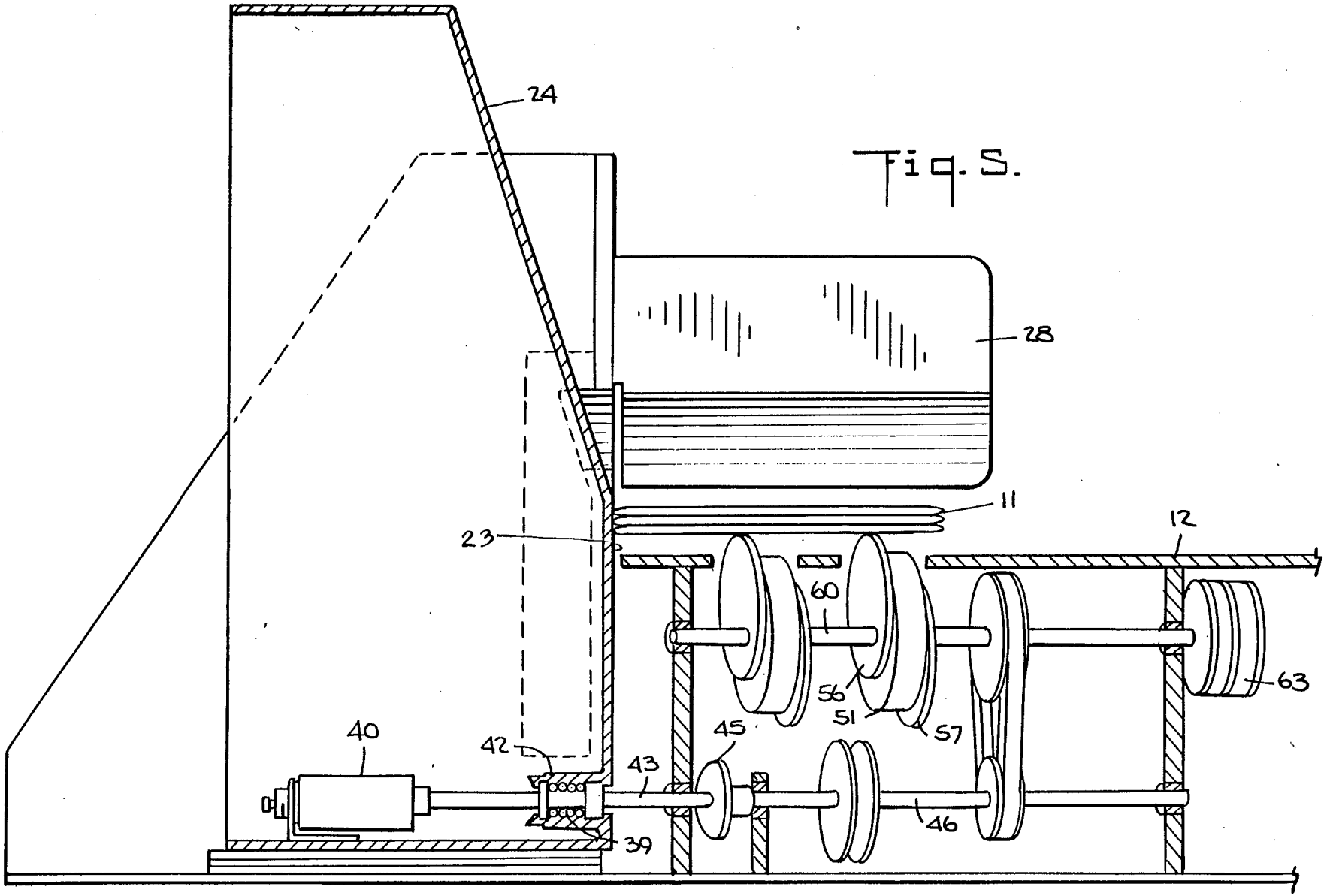
FIG. 5 is a schematic side view of the tamper and nudger subsystems used in the feeder of FIG. 1.

FIG. 1 illustrates schematically the front end of a mailing machine 5 comprising a hopper 10 holding a stack 11 of registered mail in horizontal position on a deck 12. A forward-drive mechanism 6 mounted below the deck 12 moves the stack downstream (to the right in FIG. 1) toward the singulator module, designated 15. Following singulation, the unsealed mail has the profile of its flap generated, and information based on the profile is fed via a computer to a moistener which wets the flap glue line which is then sealed. This occurs at the stations indicated generally at 16 in FIG. 1.

One of the features of the feeder of the invention is the guideless hopper. Unlike other mailing machines, there are no rear props or side guides in front that the operator must adjust to hold the stack in place. By eliminating the need for such guides, the feeder of the invention can truly be a mixed mail feeder, i.e. capable of handling mail of varying thickness and varying size, both flapped and unflapped.

FIG. 2 is a more detailed side view of the hopper region 10. It includes a deck 12 which is supported in a fixed position from below. An extension piece 20 is fixed at its left side and terminates in a tilted back wall 21. On the rear is mounted a registration side wall 22, comprising a lower vertical part 23 and an angled backward upper vertical part 24. The drive means are not shown in this view. The dashed vertical line 25 roughly demarcates the hopper region 10 from the downstream singulator 15 (not shown in this view). The deck 27 at the singulator is horizontal, i.e., level when viewed from the front (though it can be slanted downward toward the rear wall), but the deck 12 in the hopper region is angled upward by an angle of about 4°–6°, preferably 5°. In FIG. 2, the dashed line 91 is an extension of the deck surface 12, and the angle designated by 90, between line 91 and the deck 27, is about 5°. The guide 28 is located approximately at the transition between decks 12 and 27.

Figure 10:
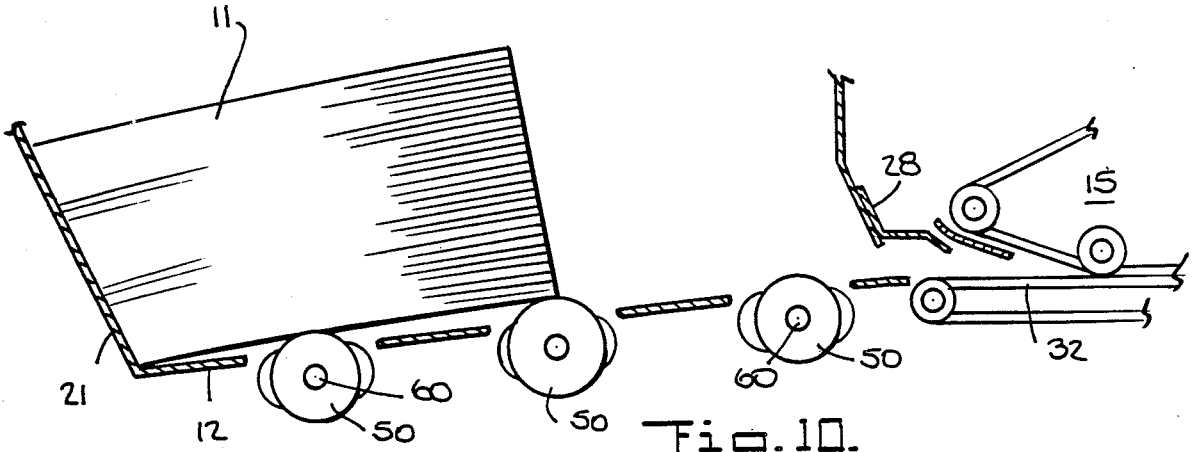
FIGS. 10–12 illustrate the shingling action of the front end feeder of the invention.
Figure 11:
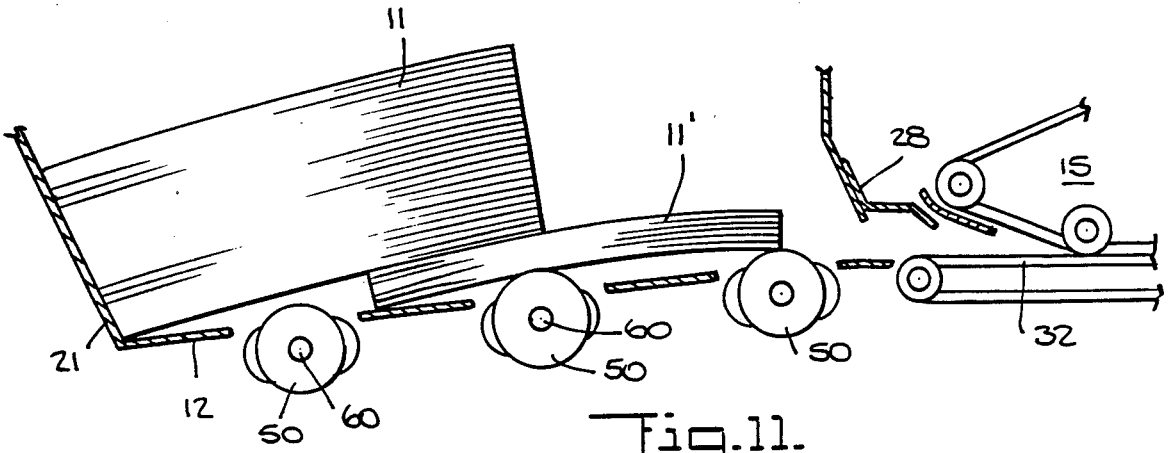
Figure 12:
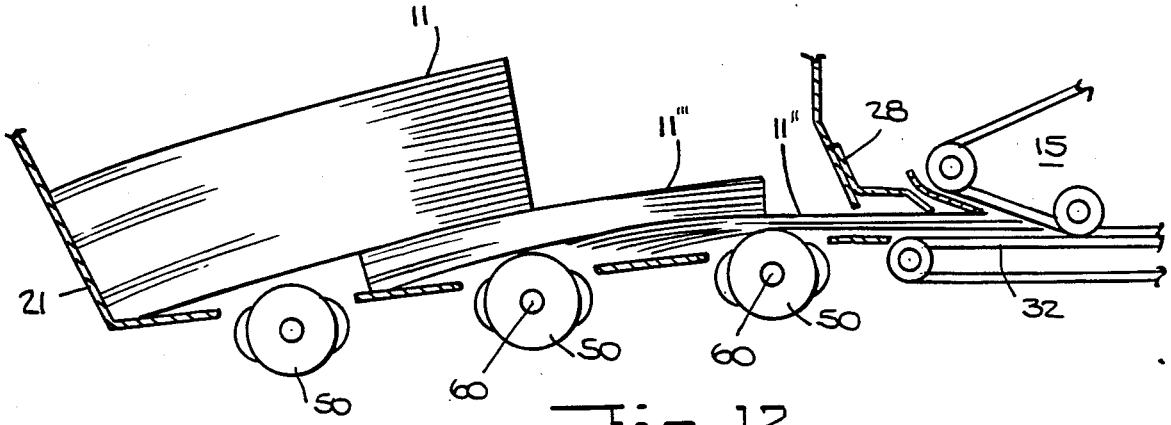

In accordance with this feature of the invention, gravity is used to keep a stack of up to 9 inches high upright in the hopper without guides. By tilting the entire mail deck up to the singulator five degrees up toward the downstream direction of the machine, the stack of envelopes will tend to lean against the back wall 21. To shift the center of gravity of the stack even further back, the back wall in the hopper is oriented about 100°–110°, preferably 105 degrees, from the surface 12 of the deck, the angle being designated by reference numeral 7. That means that the stack is actually leaning by about 20 degrees from upright. This is more than enough to compensate for the tilt of high stacks from the cumulative effect of all the extra thicknesses of the flaps and thus eliminates the need for a front guide for the stack. The need for a side guide (opposite to the wall 22) is eliminated by a similar use of gravity and by a nudger drive mechanism explained below. By slanting the deck sideways, about 6°, the mail stack is leaned toward the registration wall 22. The lean of the stack toward the back is also enhanced by stripping mail out from under the stack. As the bottom inch of the stack move into the singulation nip the stack is no longer evenly supported, and it tends to fall upstream or off the left end of the hopper deck 12. This is illustrated in FIGS. 10–12, which is further explained below.

For the machine illustrated in FIG. 2, the top of the rear wall 21 to the deck is only about 4 inches. To accommodate 9 inches of stack height, a rear wall extension (not shown) is provided that pulls up to support a nine inch stack height.

Another feature of the invention is the means by which the mixed mail is properly oriented within the machine. Mail orientation is accomplished using both novel tamping and nudging registration subsystems. The purpose is to get each mail piece in the proper orientation so that as it passes through the rest of the machine it is not skewed and the indicia is printed entirely on the upper right hand corner of the mail piece as is conventional. The object of the tamping subsystem is to register all mail pieces in the stack along the same line whether they are flapped or unflapped. Flapped mail-pieces end up with the inside of the flap pushed up against the inside edge of the deck and unflapped mail-pieces are pushed against a restraint positioned against the inner edge of the deck. The restraint is either the side wall 22 of the tamper or a flap of a subsequent mail piece being held against the inner edge of the deck by the tamper.

To understand this better, reference is made to FIGS. 3 and 4 of the drawings, which is a perspective view of the feeder of the invention, but with the rear wall 21 omitted for clarity. In these figures, the space for the singulator 15 is shown at the right, with its deck 27. Numeral 32 references the forward belt drive in the singulator. Numeral 28 references a barrier plate whose function is to limit the height of the overlapped or shingled mail entering the singulator module. The angle between the decks 12 and 27 is not shown for clarity. The singulator includes a side registration wall 29 forming with the back edge of the deck 27 a slot 30 for passage downstream of the flap of a flapped envelope. An object of the feeder in the hopper region is to introduce shingled mail into the singulator.

The mail to be processed is placed on the deck 12 of the feeder. If it is open flapped mail, the side wall 23, 24 is moved apart from the rear edge 31 of the deck to form an open slot 35, which is aligned with the slot 30 in the singulator. As shown in FIG. 3, the envelopes are placed face down with their overlapped flaps extending downward in the slot 35. If the mail is unflapped, that is, with closed flap, sealed or unsealed, the mail is stacked flap down with the flap fold edge 36 adjacent the side wall 23, 24. In this case, the latter has been moved inward to close the slot 35.

The tamper mechanism is incorporated behind the wall 23, 24 and functions when there are envelope flaps in the slot 35. As will be explained below, the wall 23, 24 is movable and can be caused to exert a varying force on the flaps in the slot 35. The force is maintained high in between feed cycles to define and maintain registration along the letter deck edge 31, and the applied force is relieved to allow free movement of mail when downstream movement is required. This is achieved by causing the tamper or registration wall to push on whatever flaps are between it and the inside edge 31 of the deck 12.

FIG. 13 is a schematic view of the tamper mechanism, seen from the back of the side wall 23, 24. The deck 12, as mentioned, is fixed. The side wall 23, 24 is movable relative to the deck 12, being mounted on linear slides 38. Inside the wall is mounted a dashpot 40 connected to a pushrod 43 mounted in a linear bearing 39 (FIG. 5) supported at 42, the pushrod 43 acting as a cam follower which engages a face cam 45. The dashpot 40 contains a light spring to urge the pushrod 43 against the cam face 45. The latter in turn is mounted on a shaft 46 driven or rotated by a motor 47 mounted beneath the deck 12. As later described, the shaft 46 is part of the forward drive mechanism in the hopper region. A tension spring 49 anchored to a base support post 48 at its right end and to the movable wall 23 at its left end functions to provide a maximum biasing force tending to pull the wall 23 against the deck edge 31.

To feed open flap envelopes the user moves the hopper wall back to create a gap 35 (FIG. 6) for flaps, then loads the hopper region 10. The hopper wall 23, 24 then moves the stack toward the machine front so that the inside of the flap on the bottom most envelope is registered against the rear edge 31 of the letter deck 12 ready to be processed. However, due to the high force required to register the flapped stack, the flaps tend to become pinched between the rear edge 31 of the letter deck and the hopper wall 23. To alleviate this situation, the hopper wall is synchronously coupled to the motor driven face cam 45 through the air dashpot 40. The dashpot 40 is adjusted so that the force the wall 23 transmits to the mail stack varies from approximately a small value of about 3 ounces to a larger value of about 24 ounces. During the downstream feed cycle (explained below) the force drops to allow free movement of the envelopes in the hopper. Between feed cycles the force rises to approximately 24 ounces to tamp and register the bottommost envelope preparing it for processing. An advantage of the dashpot-cam configuration is that a force rather than a displacement is applied to the wall 23 regardless of the wall's linear position. The dashpot is adjusted so the balance of forces on the wall is such that it appears motionless at all times.

The face cam provides, essentially, two extreme positions at opposite sides along its circumference and a gradual taper between the two extreme positions. In one, the minor lobe position, the pushrod 43 tends to be moved furthest to the right in FIG. 5, providing the heavy tamping force, and in the opposite extreme position, the major lobe, the pushrod 43 is moved furthest to the left in FIG. 5 providing the light force relief position. The rotation of the cam 45 is synchronized with the rotation of the nudger so that when the nudger is moving the envelopes downstream, the light force is applied, whereas when the nudger is fluffing the mail stack, explained below, the heavy force is applied.

Suitable sensors can be provided, if desired, to activate mechanisms to disengage the tamper from the cam 45 when no open flap is detected, in which case the spring 49 will move the tamper housing to close the gap 35. Alternatively, when a flap is detected, then the tamper is activated to function as described above. However, an advantage of the prepared system as described above is that no additional sensors are required, and, even though no flaps are present and the wall is pulsating, it doe not interfere with the machine's normal operation and is not objectionable.

The side wall 23, 24 moves sufficiently to form a slot 35 to accommodate the thickness of many flaps (up to 0.75 inch) between the wall 23, 24 and the registration edge 31 of the deck. As further illustrated in FIG. 6, the upper side wall part 24 is angled backwards about 15–19 degrees, preferably about 17 degrees, with respect to the lower portion 23. This is to accommodate the thicknesses of many flaps and to keep the right, non-flapped, edges of the envelopes in substantial alignment.

The mechanism for moving the mail downstream in accordance with another feature of the invention comprises a nudging subsystem. This drive moves mail in the mail hopper in two directions; downstream in the direction of mail flow through the machine, and toward the registration wall. In addition, as explained below, the stack is also moved upwardly in a fluffing action. Being able to feed the bottom item in a vertical stack allows a mailing machine or like paper handling device to be easy to load and to occupy a minimum of table space. This fluffing feature permits bottom feeding, which also has the advantage of being less sensitive to stack height within a reasonable range.

Another feature of this aspect of the invention is the shingling of a vertical stack of mail in preparation for singulation. Shingling helps reduce the drag forces on the lowermost item in the stack while it is being singulated.

Figure 14:
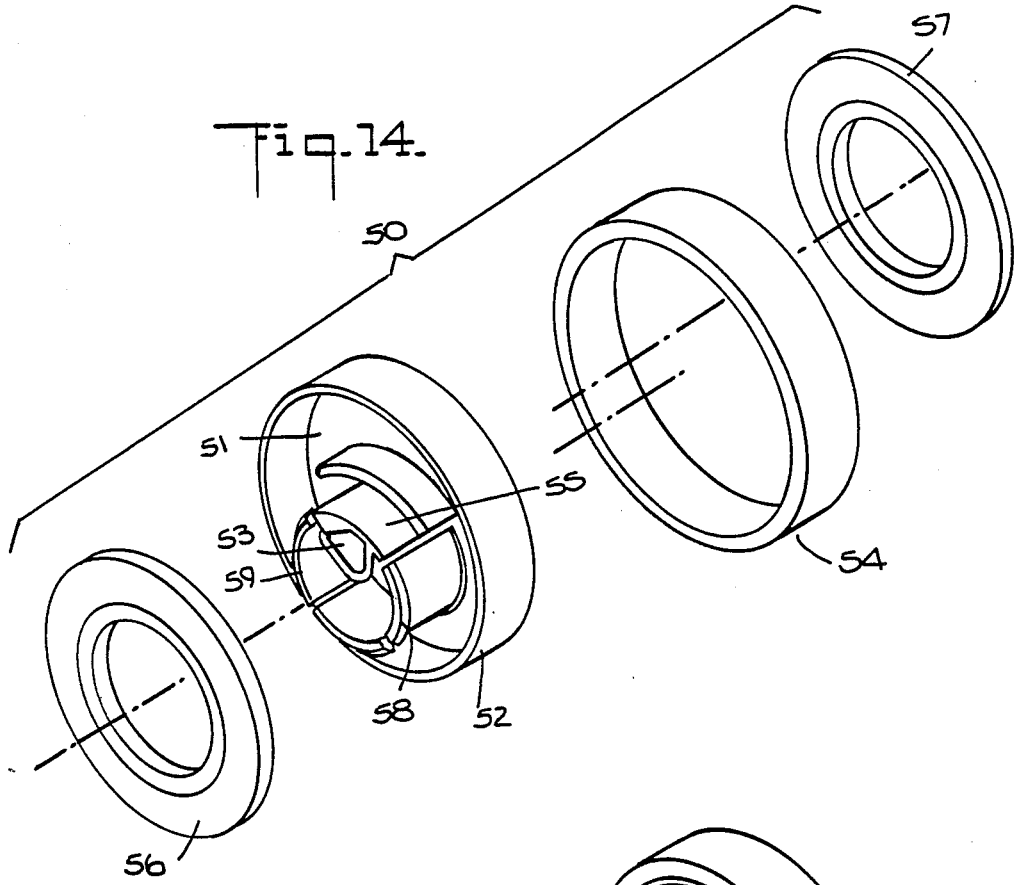
FIGS. 14 and 15 are exploded and perspective views, respectively, of a composite roller for use in the feeder of the invention.

The forward drive of the invention, in a preferred embodiment, uses a plurality of composite rollers 50 of the construction shown in FIG. 14. Each roller 50 consists of a wide core or center element 51 having a circumference 52 which is concentric with its trilobular hole 53. On this circumferential surface is elastically mounted a frictional tire 54. Located eccentric to the trilobular hole are two cantilever shaft portions 55, one shown in FIG. 14 extending to the left, and the other extending to the right and not visible in FIG. 14. Thin rollers 56 and 57 with low friction surfaces are mounted on these shaft portions 55 and are retained by means of, for example, snap latches 58 and 59. One thin roller is positioned on each side of the wide center portion. As will be noted, the shaft portions 55 are eccentric with respect to the hole 53, and are positioned such that the thin outer roller portions are offset by about 180°. See also FIG. 19. The result is that each of the outer roller portions 56, 57 extend beyond the circumference 52 of the center roller portion 51 over a small arc of about 45°. The reason for allowing the thin roller to extend beyond the outside diameter of the center roller portion is explained below.

Figure 15:
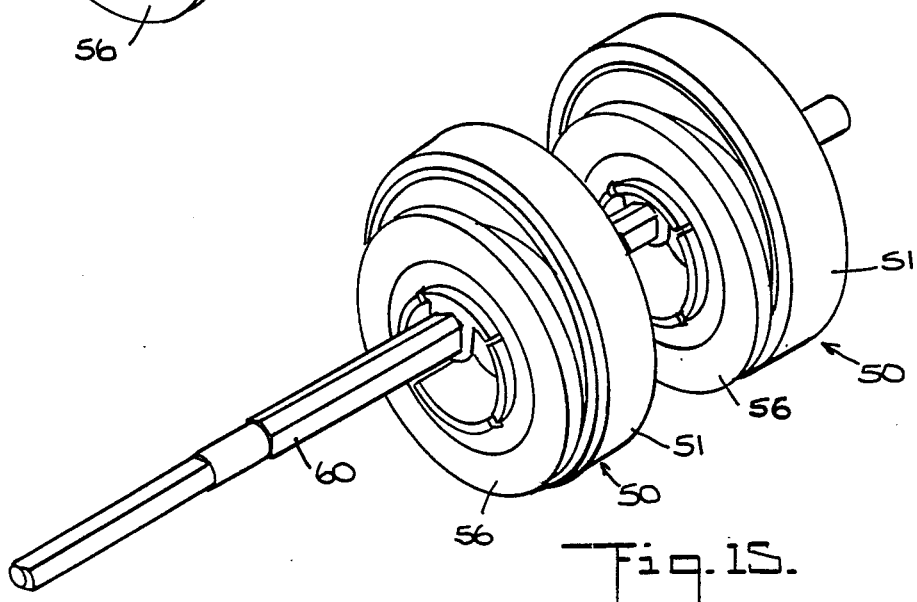

In the preferred embodiment shown in FIG. 15, pairs of these composite assemblies 50 are mounted on trilobe shafts 60 so as to establish an in-phase relationship between the roller pair such that the distance between the thin rollers 56, 57 appearing at, for instance, the 6 o'clock position, as shown in FIG. 15, remains constant as the trilobe shaft 60 is rotated. The trilobe shafting also allows the rollers to be rotatingly driven in this established orientation. FIG. 15 also shows the thin rollers 56, 57 extending beyond the circumference 52 of the core element 51 only over a short arc equal to about 90 degrees each. For the remainder of the 180° of the circumference, the core roller 51 extends beyond the thin rollers 56, 57.

Figure 16:
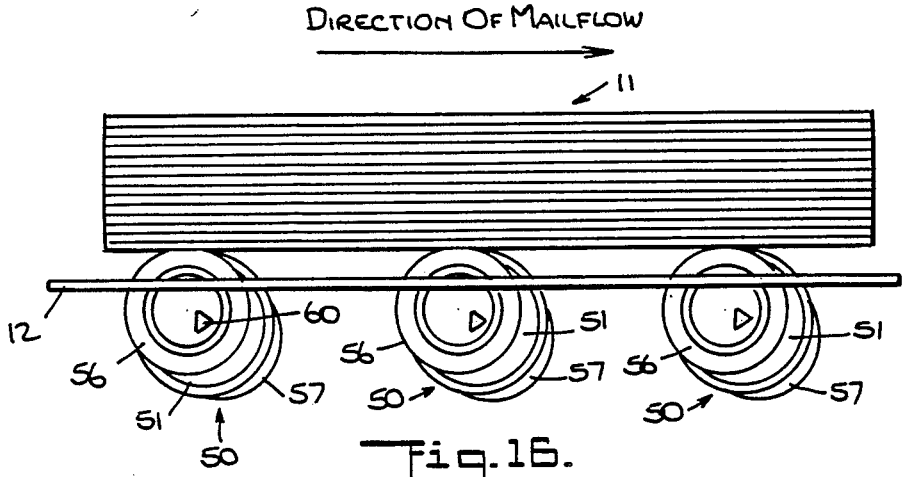
FIGS. 16–18 are side views illustrating the shingling action of th feeder of the invention.
Figure 17:
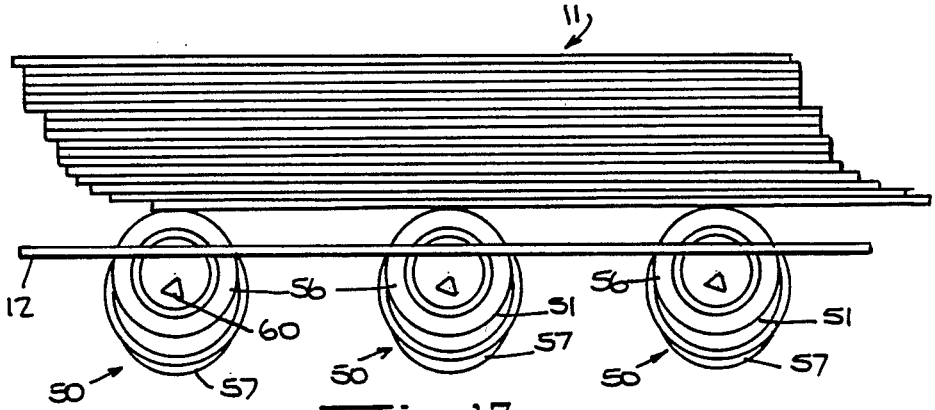
Figure 18:
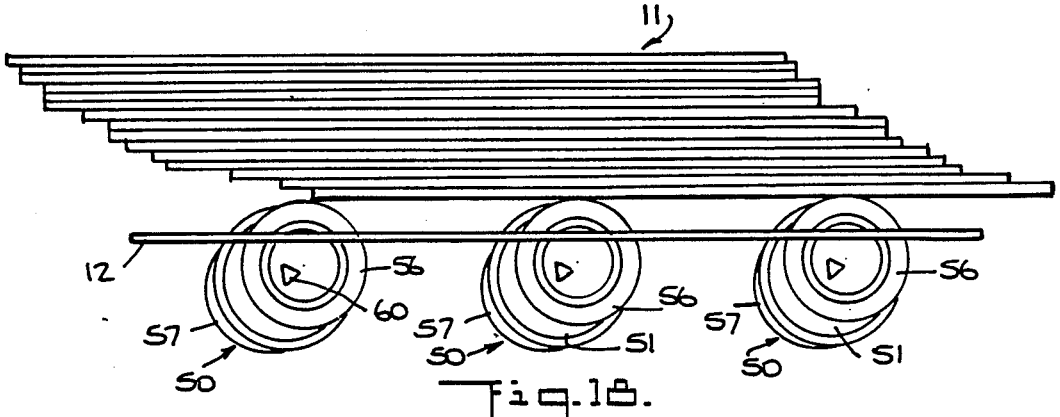
Figure 19:
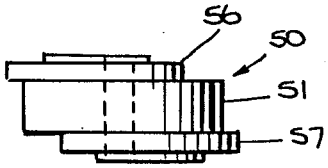
Figure 22:
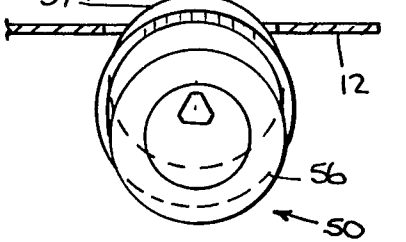
FIGS. 21–24 are schematic side views illustrating the fluffing action of the composite rollers.
Figure 21:
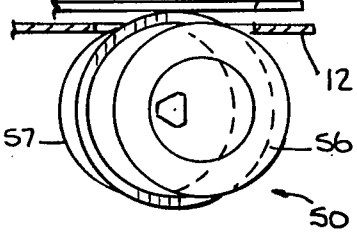

FIGS. 16–18 show a side view of three of the assemblies of FIG. 15 located with respect to the horizontal deck 12 of a feeding device and supporting a stack of mail 11 on the frictional tire surface 54 of each roller assembly 50. In the position shown in FIG. 16, the rotational drive supplied to the shafts 60 will move the stack in the direction shown by the arrow. The distance permitted between the shaft assemblies is related to the amount that the frictional tire is exposed above the horizontal deck. The distance between the shafts must be such that any envelope spanning the roller assemblies must be raised high enough by the frictional tire so that its sagging portion does not drape significantly on the deck. As one example, not to be deemed limiting, a 3.5 inch shaft center to center distance and a 0.2 inch tire to deck exposure can be used.

FIG. 17 shows a similar view except the shafts have rotated clockwise (CW) about 45°, and the stack is now supported on the thin, eccentrically mounted rollers 56. In this position, the lowest envelope in the stack is mainly subjected to the frictional force of the stack on top of it. The rollers 56, 57 below offer little frictional drag. In order that there be little or no contact of the envelope with the frictional tire 54 in this roller assembly position, the eccentrically mounted rollers 56, 57 must extend above the tire surface. In the preferred embodiment, they extend approximately 0.10 inches above the tire 54.

In rotating the roller assemblies in a clockwise direction from their position in FIG. 16 to that of FIG. 17, the stack will experience an acceleration in the vertical direction in being displaced from the tire radius to the eccentric roller radius. As the roller assembly continues on in a clockwise direction, shown in FIG. 18, the eccentric rollers arrive at a position where the stack 11 once again is beginning to rest on the tire 54. During this raising and lowering of the stack as the composite assemblies are rotated, a mild to vigorous tossing or fluffing of the stack 11 is effected depending on the rotational speed and the roller assembly geometry. This fluffing of the stack 11 contributes to enabling it to be advanced in a shingled fashion to a singulating device as shown in FIG. 18.

Figure 7:
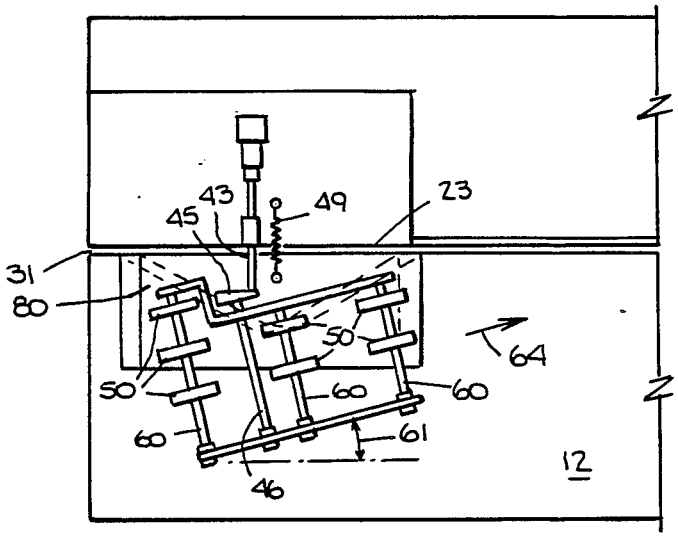
FIGS. 7–9 are top schematic views illustrating the envelope driving and nudging actions of the feeder of FIG. 1.
Figure 8:
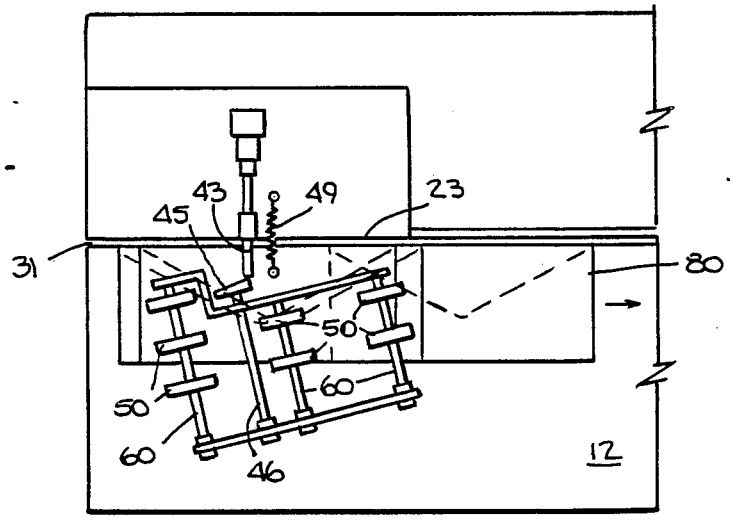
Figure 9:
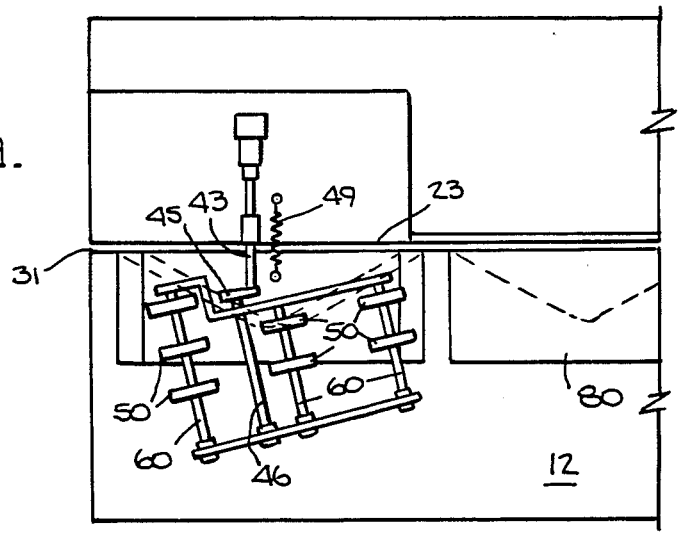

The forward drive system in the preferred embodiment comprises three axial assemblies of two, two, and three composite rollers 50, respectively, as shown in FIGS. 7–9. The shafts 60 of all three assemblies are essentially parallel, but are angled toward the registration wall 23, the angle indicated by 61 being about 10° to 16°, preferably about 13°. The shafts 60 are ganged together and driven by a common motor drive via a pulley 63, mounted under the deck 12, at the same rpm. See also FIG. 5. The same motor also belt drives the shaft 46 which rotates the cam 45. As shown in FIG. 5, the thin rollers in one position extend above the deck activating the stack above.

Figure 19:
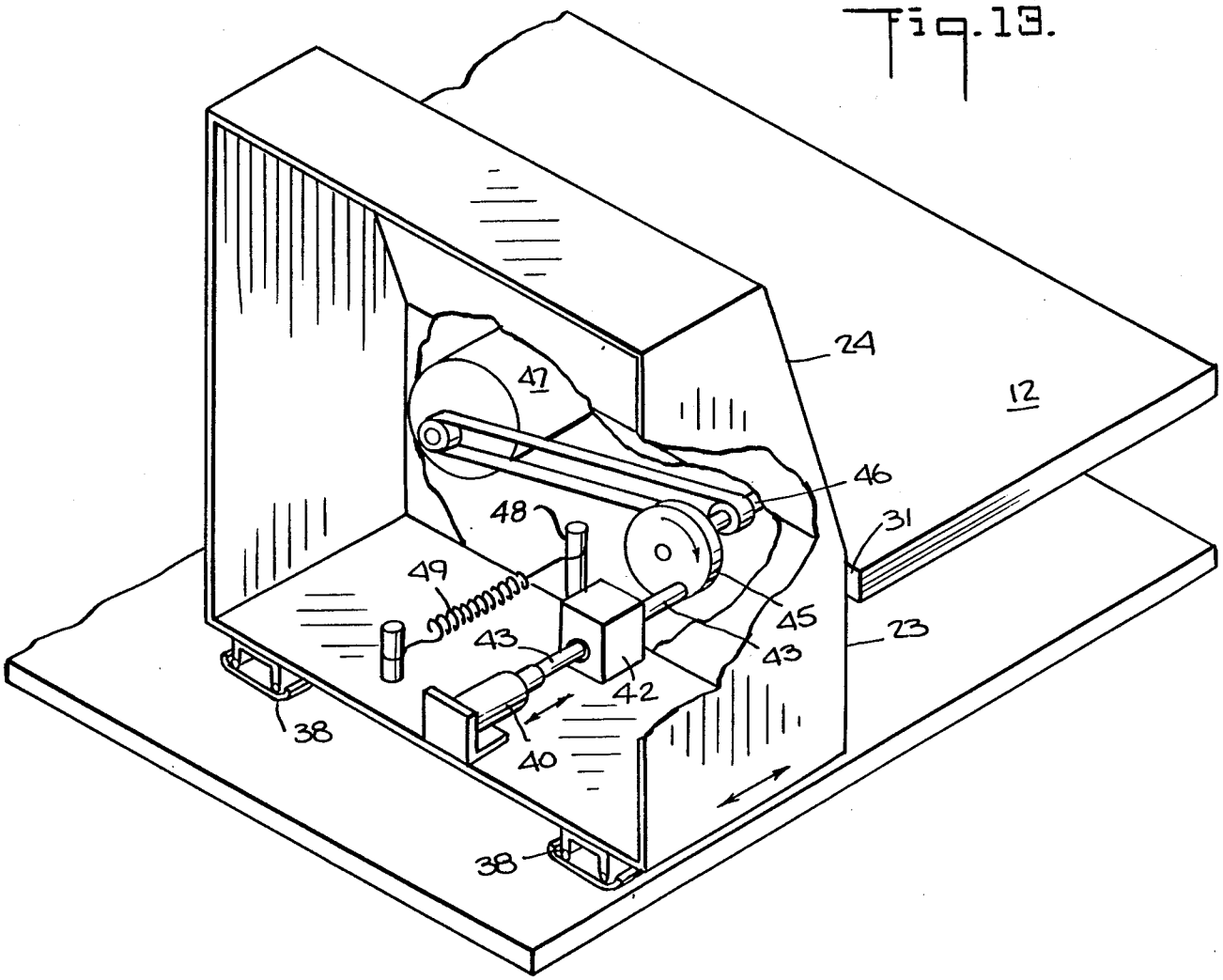
FIGS. 19 and 20 are top views, in different positions, of the composite rollers for use in the feeder of the invention.
Figure 20:
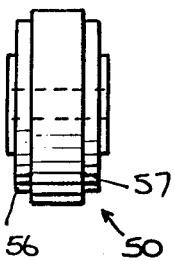
Figure 23:
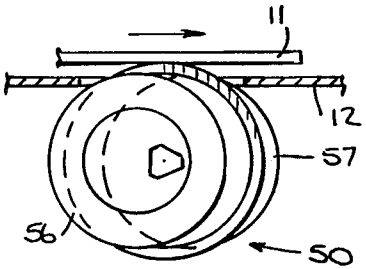
Figure 24:
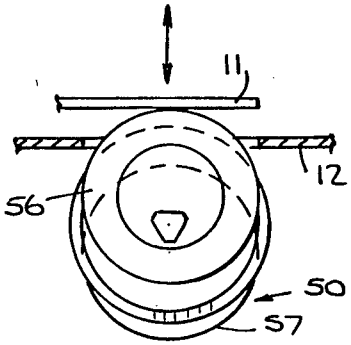

FIGS. 19 and 20 are top views of the composite rollers, taken after 90° rotation, showing more clearly how in one position, one thin outer roller 56 will protrude to one side while the other thin outer roller 57 will protrude to the other side, and after 180° of rotation later, the other thin roller 57 will protrude, whereas at the 90° and 270° positions (FIG. 20), the center roller 51 protrudes. The effect on a letter 11 of the stack is shown in FIGS. 21–24, showing 270° of rotation of the rollers. As mentioned above, the rim of the core element 51 is of rubber with a high coefficient of friction and is relatively wide, whereas the thin rollers 56, 57 on opposite sides may be constructed of plastic with a low coefficient of friction. Thus, when the core element protrudes (FIGS. 21 and 23), the envelopes are driven in the direction of rotation of rollers, downstream or forward, as well as toward the side wall 23 due to the angled position of the rollers (FIGS. 7–9), as shown by the arrow 64 in FIG. 7. In the rotated positions of FIGS. 22 and 24, where the thin outer rollers predominate, the action is mostly vertical to fluff up the stack to reduce frictional forces between the envelopes. This combined forward and fluffing action causes the stack to begin shingling as illustrated in FIG. 18. In addition, the backward tilt of the deck illustrated in FIGS. 10–12 also causes the stack to tilt backward as shown, which is important in reducing the weight of the stack on the lowermost envelopes and makes it easier for the singulator 15 to separate individual mail pieces.

FIG. 10 shows a stack 11 of mail being deposited at the rear in the hopper section against wall 21 before activation of the drive. FIG. 11 shows how activation of the drive typically causes a section 11' of the stack to be separated and driven forward. While the initial forward motion would tend to carry the whole stack forward, the fluffing rollers and the inclined deck tend to cause the upper part of the stack to tilt and fall backward against the rear wall 21, while a handful of envelopes 11' are driven forward. The continued driving and fluffing action causes the initial handful 11' to become shingled 11'' and thus pass in that condition under the barrier 28 and be driven forward into the singulator 15 by the belt drive 32. The continued forward drive then causes a second section 11''' to become separated from the stack 11 and undergo the same shingling action as the first section 11', and this continues until the hopper becomes depleted of envelopes.

To optimize the above-described action, we have found it desirable to adjust the relative phase of the fluffing rollers in the three axis drive. By "phase" is meant the orientation of the outer fluffing roller 56, 57 on one roller to that on another roller. "In phase" means that, viewed from the front, they are aligned. In particular, it is preferred that the rollers 50 (FIG. 9) on each shaft 60 are all in phase with one another; and the rollers 50 in all three of the assemblies are also in phase with one another.

Another feature that contributes to the pre-shingling action desired is a selection of frictional coefficients for the main center or drive roller 51 for the three roller assemblies. In particular, we prefer that a material be chosen for the drive tire 54 for the three-roller assembly in the extreme upstream position which has the highest coefficient, for the middle two-roller assembly the lowest coefficient, and for the extreme downstream assembly a higher coefficient. This is because the principal advancing forces will be provided by the end roller assemblies. The higher coefficient is especially important for the upstream assembly because of the greater stack weight. Various types of rubber tires with different frictional coefficients are well-known and are available for this purpose.

FIGS. 7–9 also show the profile of the cam face 45 relative to the follower 43. In the position shown in FIG. 7, the follower 43 is on the minor lobe of the cam face and the heavy force is being applied by spring 49 for tamping the flapped envelopes shown at 80. In the view of FIG. 8, 180° of rotation later, the major lobe of the cam face 45 has applied a reverse force to the wall 23 so that a light force now exists, which allows an envelope 80 to be advanced. FIG. 9 shows 180° of rotation later a return to the condition of FIG. 7.

Figure 25:
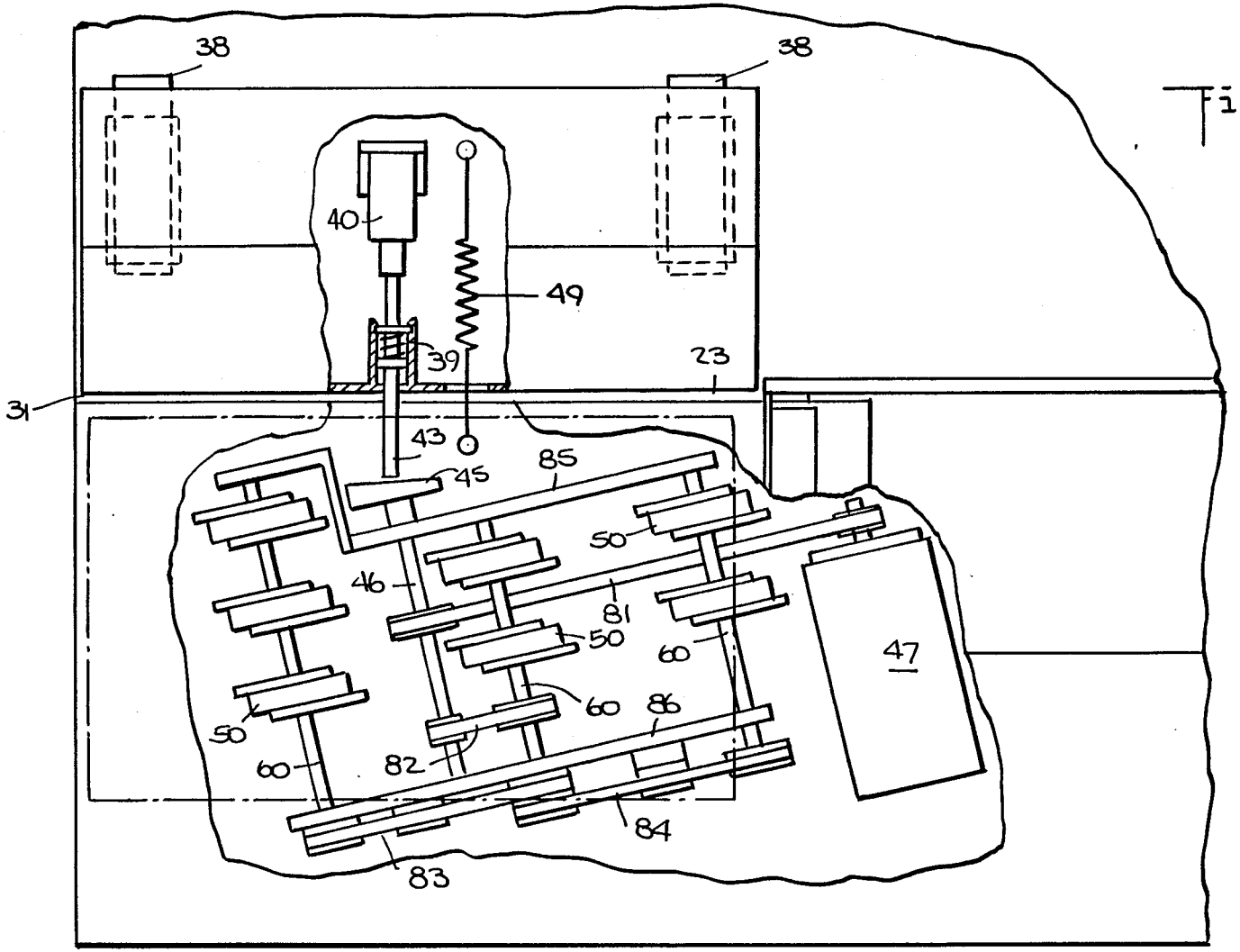
FIG. 25 is a top view of the front end feeder of the invention with part of the deck removed showing the synchronized driving of the nudger and tamper subsystems.

FIG. 25 illustrates a preferred embodiment for driving the cam 45 and roller assemblies. A motor 47 belt-drives 81 shaft 46 to which the cam 45 is attached. The shaft 46 in turn belt-drives 82 the adjacent roller shaft 60, which in turn belt-drives 83, 84 the end roller shafts 60. All the shafts of the drive are supported for rotation by end mounts 85, 86.

It is preferred that the rollers 50 be driven such that the surface speed of the frictional tire 54 is in the range of about 24–32 inches per second (ips). We have found that, for the preferred machine described above intended to handle mixed mail at the rate of up to about four per second, if the surface speed is substantially greater than 32 ips, then excessive vibration of the stack occurs that actually reduces the throughput. On the other hand, when the surface speed falls below about 24 ips, then the mail pieces are not fluffing properly and producing the desired shingling profile. In the range indicated, we prefer the value of 28 ips as optimum.

Figure 6:
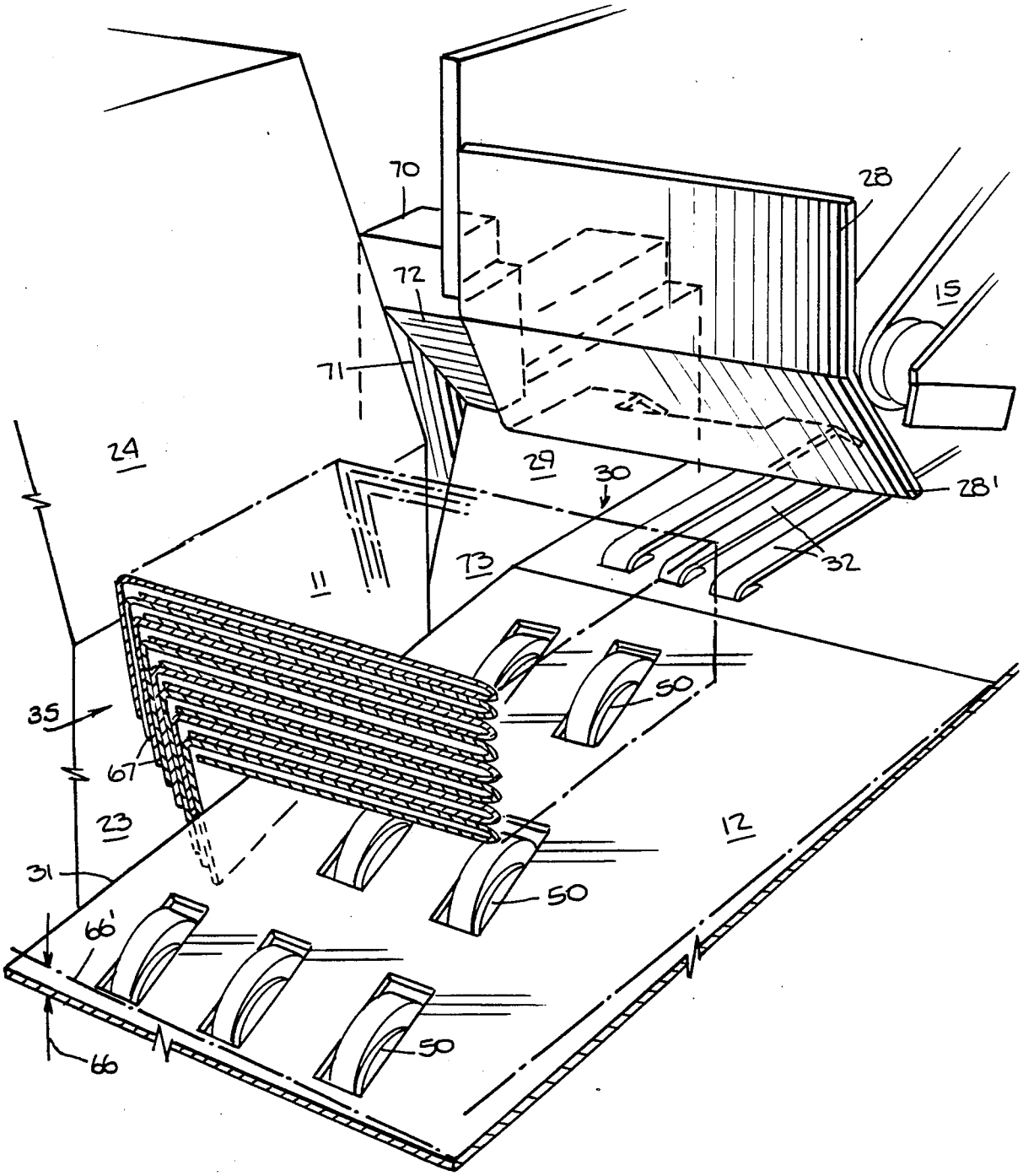
FIG. 6 is a perspective view of the feeder of FIG. 3 illustrating operation with multiple flapped envelopes.

As mentioned above, the envelopes are driven forward as well as toward the registration side wall 23, 24. This action is assisted by a tilting of the deck 12 about 4°–8°, preferably 5°, downward toward the side wall, indicated by 66 in FIG. 6 with the dash-dot line 66' being horizontal. FIG. 6 also shows, somewhat schematically, a stack of envelopes Il whose flaps 67 extend into the slot 35 adjacent the deck edge 31. It is important that the stack 11 as it shingles continues to maintain the envelope flaps 67 in the slot. A further feature of the invention is structure downstream of the tamper wall 23, 24 but before the singulator 15 which is configured to guide the envelope flaps as they shingle down into the slot 35 and into the slot 30 in the singulator module. This structure consists of a vertical wall portion 70 surface 71 which slopes downstream, downward and toward the machine front, which intersects a second surface 72 which slopes downward and downstream, merging finally with a nearby vertical major surface 73. Preferably, the surface 72 forms an angle of about 30 degrees-40 degrees, with 35 degrees being preferred, with a vertical plane. This angle substantially matches the angle formed by the leading edges of the ideal shingled stack of mail. It also matches the angle at which the bent lower part 28' of the guide 28 extends. The surface 71 is adjusted to guide the flapped mail stack downstream toward the singulation area without causing any restriction or binding. A preferred angle for that surface is about 107 degrees with respect to the deck, and can vary about 5 degrees either way. See also FIGS. 26 and 27. As shown in FIG. 27, the major surface 73 is angled backwards by a small angle of about 1 degrees to 4 degrees, preferably about 2 degrees. In the figure, line 74 parallels the registration edge 31, and the angle indicated by numeral 75 represents about 2°. The surface 71, is angled indicated by reference numeral 76, preferably between about 35–39 degrees, preferably about 37 degrees, backward with respect to the surface 73. These angular ranges have proven desirable in this particular machine embodiment dealing with No 5 to No. 15 envelopes with thicknesses up to three-quarters inches.

The operation of the system is based on on-demand feeding, with upstream actions and movements conditioned on the downstream envelope having completed its processing. Assuming this has been done, the nudger tamper subsystem, i.e., the forward drive, is activated whenever there is mail in the hopper covering a hopper sensor (not shown). This is a reflective optical sensor which looks through the hopper deck. Preferably three reflective sensors are provided of which the covering of any one will activate the subsystem. Two are is located in the open area of the hopper and the other is located in the nip area of the singulation module. This ensures that the machine will continue to function while there is any mail piece waiting to be processed.

Each of the features shown and described herein, including the flap edge tamper subsystem, the angled nudger drive subsystem which drives the envelopes downstream as well as toward the side wall, the fluffing action of the drive wheels which together with the angled deck and back support provide the desired shingling action, are believed to be novel in themselves in the preferred environment of a high speed, mixed mail handling machine, and are also considered significant parts and contributors to the high performance of the overall front end feeder combination. Thus, under certain conditions, some features of the present invention may be omitted, or used alone, or used with some but not all of the disclosed features. And the present invention is intended to include individual features of the overall system disclosed herein, as well as combinations of some of the disclosed features without other disclosed features, as well as the overall combination.

The principles of operation described above for these novel subsystems, while considered especially applicable in the environment of a mixed mail handling machine, are also considered applicable to the feeding of other articles from stacks, such as sheets of paper.

Moreover, many of the details given above for the preferred embodiment intended to handle a specific range of envelope sizes and thicknesses are not critical and can obviously be replaced by equivalent means. For instance, the shaft belt drives can be substituted by gearing, and the face cam by any other structure which intermittently forces back the push rod. Alternatively, since these state-of-the-art mail handling machines are frequently controlled by a computer, such as a microcontroller, it is also possible to substitute a solenoid which is pulsed in synchronism with the nudger-fluffer subsystems such that the tamper force is reduced during the envelope driving phase and increased during the stack fluffing phase, or a cam and spring system. Still further, other constructions of the fluffing rollers can be substituted, so long as each roller includes a protruding high friction drive part over part of the circumference and a protruding low friction fluffing part over another part of the circumference. Also the phase relationships of the fluffing and drive parts may be different than as described for different kinds of articles.

While the invention has been described and illustrated in connection with preferred embodiments, many variations and modifications as will be evident to those skilled in this art may be made therein without departing from the spirit of the invention, and the invention as set forth in the appended claims is thus not to be limited to the precise details of construction set forth above as such variations and modifications are intended to be included within the scope of the appended claims.

What is claimed is:

1. Feeder apparatus for stacked articles comprising:

(a) a hopper region for receiving a stack of articles, said hopper region comprising a deck, and a side wall, (b) transport means located in the hopper region for nudging articles toward the side wall while simultaneously moving them in a downstream direction, (c) means for fluffing the stack to allow advancement of lower articles in said stack as they are moved downstream, (d) a slot alongside the side wall for receiving flaps of the stacked articles, (e) means connected to the side wall for causing the side wall to tamp the flaps against a deck side edge, and, (f) means for synchronizing the tamping action on the flaps with the transport means.

2. Feeder apparatus as set forth in claim 1, wherein said transport means comprises forward drive means mounted in the deck in such a manner that they drive articles both in a forward direction as well as sideways toward the side wall.

3. Feeder apparatus as set forth in claim 1, wherein said deck is angled to assist in the selective advancement and to maintain the advancing articles against the side wall.

4. Feeder apparatus as set forth in claim 1 wherein the hopper region functions without a front guide and a side guide opposite to the side wall.

5. Feeder apparatus for stacked articles comprising:

(a) a hopper region for receiving a stack of articles, said hopper region comprising a deck, a rear wall, and a side wall, (b) transport means located in the hopper region for moving articles toward the side wall and in a downstream direction away from the rear wall, said transport means having a plurality of rollers whose axes of rotation form an acute angle with the side wall in such a manner that the rollers drive articles both in a forward direction as well as sideways toward the side wall, and, (c) said transport means and hopper region cooperating to cause said articles as they are moved downstream to assume a shingled configuration with lower articles in the stack being advanced downstream ahead of upper articles in the stack.

6. Feeder apparatus as set forth in claim 5, wherein said transport means include fluffing means for fluffing the stack of articles to assist in causing them to assume the shingled condition.

7. Feeder apparatus as set forth in claim 5, wherein said deck is angled upward in the downstream direction causing the stack during operation to tilt backwards against the rear wall.

8. Feeder apparatus as set forth in claim 7, wherein said rear wall is tilted backwards.

9. Feeder apparatus as set forth in claim 7, wherein the deck forms an angle of about 4°–6° with a horizontal plane.

10. Feeder apparatus as set forth in claim 7, wherein said deck is also angled sideways down toward the side wall.

11. Feeder apparatus as set forth in claim 10, wherein said deck sideways angle is about 3°–7° with respect to a horizontal plane.

12. Feeder apparatus as set forth in claim 6 wherein said fluffing means comprise said rollers having offset roller portions which intermittently contact the articles.

13. Feeder apparatus as set forth in claim 12, wherein the offset roller portions comprise a portion mounted on and eccentrically rotating with a drive shaft.

14. Feeder apparatus as set forth in claim 13, wherein each of a plurality of the rollers comprises a central cylindrical portion with a relatively high coefficient of friction and on opposite sides outer portions each having a relatively low efficient of friction and a region extending beyond the central roller circumference.

15. Feeder apparatus as set forth in claim 14, wherein the extending regions of the outer portions are out of phase with one another.

16. Feeder apparatus as set forth in claim 15, wherein the extending regions are 180 degrees out of phase with one another.

17. Feeder apparatus as set forth in claim 13, wherein the transport means comprise several rows of multiple rollers offset in the forward direction.

18. Feeder apparatus as set forth in claim 17 wherein the central rollers in one row have a different coefficient of friction than the central rollers in a different row.

19. Feeder apparatus as set forth in claim 5, wherein the articles are stuffed envelopes.

20. Feeder apparatus as set forth in claim 19, wherein the envelopes include sealed and unsealed envelopes.

21. Feeder apparatus as set forth in claim 7, in combination with a singulator downstream of the feeder, the singulator having a deck for receiving articles from the deck of the hopper region, said singulator deck being substantially horizontal forming an obtuse angle at its transition with the hopper region deck, and means located above the deck transition for blocking movement downstream of articles above a certain level.

22. Feeder apparatus as set forth in claim 5 wherein the transport means are driven to provide a surface speed of between about 24 to 32 ips.

* * * * *